US011145281B1

(12) United States Patent
Liang

(10) Patent No.: US 11,145,281 B1
(45) Date of Patent: Oct. 12, 2021

(54) STRINGED INSTRUMENT AND BROKE STRING ENERGY ABSORBING DEVICE THEREOF

(71) Applicant: SHENZHEN MEIDEAL MUSICAL INSTRUMENTS Co., Ltd., Guangdong (CN)

(72) Inventor: Zhihui Liang, Guangdong (CN)

(73) Assignee: SHENZHEN MEIDEAL MUSICAL INSTRUMENTS CO., LTD., Guangdong (CN)

( * ) Notice: Subject to any disclaimer, the term of this patent is extended or adjusted under 35 U.S.C. 154(b) by 261 days.

(21) Appl. No.: 16/603,493

(22) PCT Filed: Aug. 30, 2018

(86) PCT No.: PCT/CN2018/103195
§ 371 (c)(1),
(2) Date: Oct. 7, 2019

(87) PCT Pub. No.: WO2019/214115
PCT Pub. Date: Nov. 14, 2019

(30) Foreign Application Priority Data

May 11, 2018 (CN) ..... 201810451278.9

(51) Int. Cl.
*G10D 3/18* (2020.01)
*G10D 3/06* (2020.01)

(52) U.S. Cl.
CPC ..... *G10D 3/18* (2013.01); *G10D 3/06* (2013.01)

(58) Field of Classification Search
CPC ..... G10D 3/18; G10D 3/06
See application file for complete search history.

(56) References Cited

FOREIGN PATENT DOCUMENTS

| | | | | |
|---|---|---|---|---|
| CN | 2122420 U | | 11/1992 | |
| CN | 206412076 U | | 8/2017 | |
| CN | 108389560 A | | 8/2018 | |
| DE | 4408696 C1 | * | 7/1995 | ..... G10D 3/14 |
| JP | H01179083 A | | 7/1989 | |

* cited by examiner

*Primary Examiner* — Kimberly R Lockett
(74) *Attorney, Agent, or Firm* — Craft Chu PLLC; Andrew W. Chu

(57) ABSTRACT

The broken string energy absorbing device includes a fixing mechanism and a cushioning and energy absorbing mechanism. The fixing mechanism is configured to fix the broken string energy absorbing device to a neck of the stringed instrument. The cushioning and energy absorbing mechanism is configured to absorb and weaken the energy when a string of the stringed instrument is broken. The present invention can sufficiently protect the user from not being exploded by the broken string when tuning the strings, which effectively ensures the safety of the user when tuning. The user no longer has the psychological burden of worrying about whether the string will be broken, so that the user can safely tune the strings, which provides good user experience and is favorable for the user to further learn the instrument.

10 Claims, 3 Drawing Sheets

STRINGED INSTRUMENT AND BROKE STRING ENERGY ABSORBING DEVICE THEREOF

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM EFS-WEB

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the field of musical instrument accessories, and more particularly to a stringed instrument and a broken string energy absorbing device thereof.

2. Description of Related Art Including Information Disclosed Under 37 CFR 1.97 and 37 CFR 1.98

Tuning is one of the necessary means for the daily maintenance of the instrument. In the process of tuning the strings of some stringed instruments such as guitar, violin, ukulele, banjo, pipa, mandolin, especially for those who lack experience, the strings are apt to be broken so as to injure the operator; and some people are prone to feel fearful after being first exploded by the broken string, which greatly affects the personal experience and is unfavorable to further learn the instrument. Therefore, there is now a need for an effective means of preventing the broken string from injuring the operator when tuning.

BRIEF SUMMARY OF THE INVENTION

In view of the above deficiencies of the prior art, it is an object of the present invention to provide a stringed instrument and a broken string energy absorbing device thereof which can absorb the energy when a string of the stringed instrument is broken, thereby effectively preventing the broken string from injuring the operator.

In order to solve the above technical problems, the present invention adopts the following technical solution.

A broken string energy absorbing device applied to a stringed instrument includes a fixing mechanism and a cushioning and energy absorbing mechanism. The fixing mechanism is configured to fix the broken string energy absorbing device to a neck of the stringed instrument. The cushioning and energy absorbing mechanism is disposed on the fixing mechanism and is spaced apart from the strings of the stringed instrument by a preset distance, and is configured to absorb and weaken the energy when a string of the stringed instrument is broken.

Further, the fixing mechanism includes a pair of clamping components for clamping both sides of the neck.

Further, the cushioning and energy absorbing mechanism includes a cushioning panel, and both sides of the cushioning and energy absorbing mechanism and a bottom surface of the cushioning panel are provided with a cushioning layer made of cushioning and energy absorbing material respectively.

Further, the broken string energy absorbing device further includes an adjusting mechanism configured to adjust the distance between the cushioning and energy absorbing mechanism and the strings.

In a preferred embodiment, the adjusting mechanism includes an adjusting bolt. The cushioning and energy absorbing mechanism is provided at a middle position thereof with a threaded hole that mates with the adjusting bolt. The cushioning panel is fixed at an end of the adjusting bolt passing through the threaded hole, and can rotates in a plane about the end of the adjusting bolt passing through the threaded hole.

In a preferred embodiment, the clamping component is hinged at a middle position thereof with the cushioning and energy absorbing mechanism. An upper portion of the clamping component is a clamping handle. A spring is provided between the clamping handle and the cushioning and energy absorbing mechanism for fastening and resetting the clamping component.

In a preferred embodiment, the cushioning and energy absorbing mechanism further includes a sleeve member configured to be telescopically moved on the cushioning and energy absorbing mechanism and an elastic member configured to reset the sleeve member. An upper end of the clamping component is fixed to the sleeve member.

In a preferred embodiment, the fixing mechanism further includes a fastening bolt. The clamping component includes a first clamping component and a second clamping component. The first clamping component is fixed at one end of the cushioning and energy absorbing mechanism; and the second clamping component mates with the fastening bolt so as to be mounted at the other end of the cushioning and energy absorbing mechanism.

In a preferred embodiment, the clamping component and the cushioning and energy absorbing mechanism are integrally made of a silica gel material. The broken string energy absorbing device is further provided with a positioning member that maintains a certain distance between the cushioning and energy absorbing mechanism and the strings.

A stringed instrument includes a neck. The neck is provided with at least one broken string energy absorbing device as described above. The broken string energy absorbing device is clamped on the neck and is spaced apart from the strings of the stringed instrument by a preset distance.

Compared with the prior art, the present invention provides a stringed instrument and a broken string energy absorbing device thereof. The broken string energy absorbing device includes a fixing mechanism and a cushioning and energy absorbing mechanism. The fixing mechanism is configured to fix the broken string energy absorbing device to a neck of the stringed instrument. The cushioning and energy absorbing mechanism is configured to absorb and weaken the energy when a string of the stringed instrument is broken. The present invention can sufficiently protect the user from not being exploded by the broken string when tuning the strings, which effectively ensures the safety of the user when tuning; and simultaneously, the present invention can make the user no longer have the psychological burden of worrying about whether the string will be broken, so that the user can safely tune the strings, which provides good user experience and is favorable for the user to further learn the instrument; and the present invention has the advantages of simple structure, low cost and easy promotion.

DETAILED DESCRIPTION OF THE INVENTION

In order to make the objects, technical solutions and advantages of the present invention clearer and more obvious, the present invention will be further described in detail below with reference to the accompanying drawings and embodiments. It should be understood that the specific embodiments described herein are merely illustrative of the present invention and are not intended to limit the present invention.

It should be noted that when a component is referred to as being "mounted on", "fixed on" or "disposed on" another component, the component may be directly on the other component, or there may be an intermediate component. When a component is referred to as being "connected to" another component, the component may be directly connected to the other component, or there may be an intermediate component.

It should also be noted that the directional terms such as left, right, upper and lower in the embodiments of the present invention are merely relative concepts or referenced to the normal use state of the product, and should not be considered as limiting.

Figure 1:
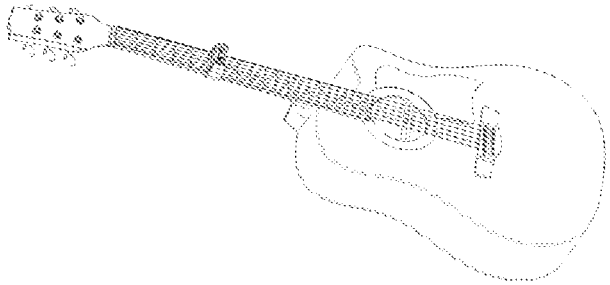
FIG. 1 is a schematic view showing the use effect of a broken string energy absorbing device applied to the guitar according to the present invention.
Figure 2:
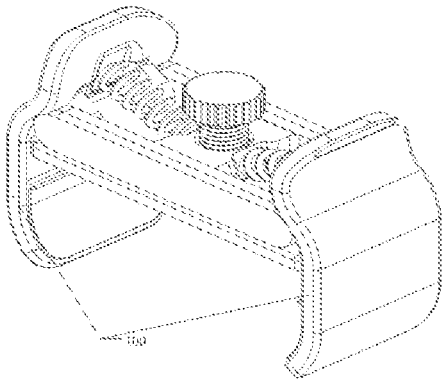
FIG. 2 is a schematic structural view of the broken string energy absorbing device according to a first preferred embodiment of the present invention.

As shown in FIG. 1 and FIG. 2, the present invention provides a broken string energy absorbing device applied to a stringed instrument, and the most widely used guitar is taken as an example in the following embodiments. The broken string energy absorbing device includes a fixing mechanism (not numbered in the figures) and a cushioning and energy absorbing mechanism (not numbered in the figures). The cushioning and energy absorbing mechanism is disposed on the fixing mechanism and is spaced apart from the strings of the stringed instrument by a preset distance. The fixing mechanism is configured to fix the broken string energy absorbing device to a neck.

The broken string energy absorbing device according to the present invention is firmly fixed on the neck by the fixing mechanism, prevents the sudden smashing of the string when the string is broken by the cushioning mechanism, and absorbs and weakens the energy when the string is broken, which effectively prevents the string from exploding the people when the string is suddenly broken. The cushioning and energy absorbing mechanism is configured to absorb and weaken the energy when the string is broken, which effectively ensuring the safety of the user when tuning; and simultaneously, the cushioning and energy absorbing mechanism can make the user no longer have the psychological burden of worrying about whether the string will be broken, so that the user can safely tune the strings, which provides good user experience and is favorable for the user to further learn the instrument.

Further, the fixing mechanism includes a clamping component 100. There is a pair of the clamping components 100 for clamping both sides of the neck. The structure of the fixing mechanism is simple and effective.

Figure 3:
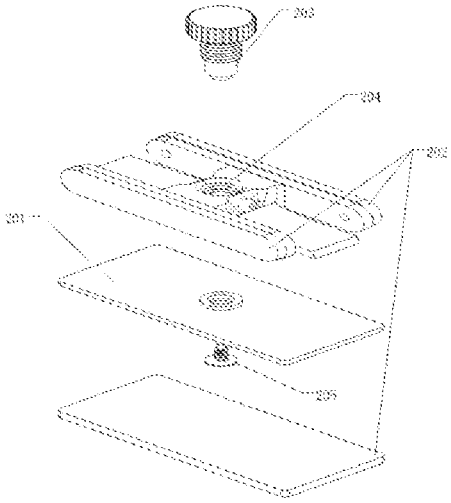
FIG. 3 is a schematic exploded view of a cushioning and energy absorbing mechanism and an adjusting mechanism according to the first preferred embodiment of the present invention.

Referring to FIG. 2 and FIG. 3, the cushioning and energy absorbing mechanism includes a cushioning panel 201, and both sides of the cushioning and energy absorbing mechanism and a bottom surface of the cushioning panel 201 are provided with a cushioning layer 202 made of cushioning and energy absorbing material respectively. The cushioning layer 202 may be made of a soft silica gel material, and such a cushioning layer 202 is beneficial to increase the contact surface with the cushioning and energy absorbing mechanism when the string is broken, and is beneficial to ensure that the energy when the string is broken is absorbed and weakened by the cushioning and energy absorbing mechanism as much as possible, thereby further ensuring the effectiveness of product functions.

Preferably, the broken string energy absorbing device further includes an adjusting mechanism (not numbered in the figures) configured to adjust the distance between the cushioning and energy absorbing mechanism and the strings. The cushioning and energy absorbing mechanism maintains a certain distance from the strings to ensure that the strings can still be driven when the tuning is performed and to determine whether the strings are calibrated or not according to the sound of the strings. The adjusting mechanism can adapt the present invention to different positions on the neck, which increases the adaptability of the present invention and is favorable to increase the humanization of product use.

Further, the adjusting mechanism includes an adjusting bolt 203. The cushioning and energy absorbing mechanism is provided at a middle position thereof with a threaded hole 204 that mates with the adjusting bolt 203. The cushioning panel 201 is fixed at an end of the adjusting bolt 203 passing through the threaded hole 204, and can rotates in a plane about the end of the adjusting bolt 203 passing through the threaded hole 204. The end of the adjusting bolt 203 passing through the threaded hole 204 is a stepped shaft. The cushioning panel 201 is provided at the center thereof with a countersunk through hole (not numbered in the figures) and is sleeved on the stepped shaft, and then the cushioning panel 201 is limited on the stepped shaft by a flat-head screw 205. The cushioning panel 201 can be smoothly moved up and down with the adjusting bolt 203 without being affected by the rotation of the adjusting bolt 203.

In addition, since the cushioning panel 201 can rotate in a plane, the user can adjust the rotation angle thereof, and the cushioning panel 201 can be pressed on a plurality of strings by the adjusting bolt 203, thereby functioning to change or adjust the tone, which enriches the functions of the product, is beneficial to reduce the difficulty of the string fingering method, and further improves the user's entertainment experience.

Preferably, in a first preferred embodiment of the present invention, the clamping component 100 is hinged at a middle position thereof with the cushioning and energy absorbing mechanism. An upper portion of the clamping component 100 is a clamping handle. A spring (not numbered in the figures) is provided between the clamping handle and the cushioning and energy absorbing mechanism for fastening and resetting the clamping component. Such a simple clamping structure is easy and convenient to operate, and has a low production cost.

Figure 4:
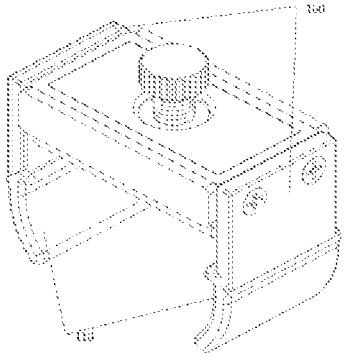
FIG. 4 is a schematic structural view I of the broken string energy absorbing device according to a second preferred embodiment of the present invention.
Figure 5:
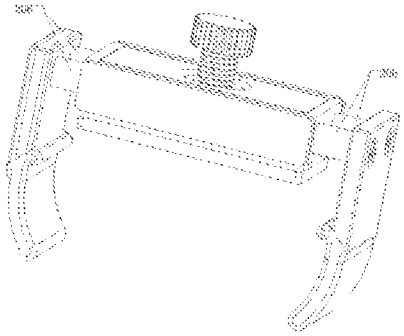
FIG. 5 is a schematic structural view II of the broken string energy absorbing device according to the second preferred embodiment of the present invention.
Figure 6:
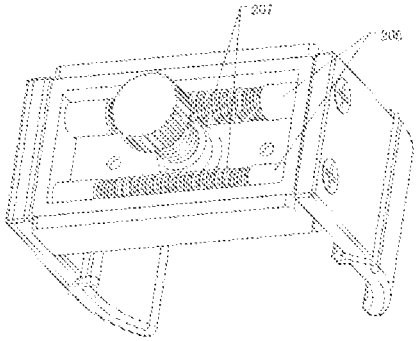
FIG. 6 is a schematic view showing the internal structure of the broken string energy absorbing device according to the second preferred embodiment of the present invention.

With continued reference to FIG. 4 to FIG. 6, in a second preferred embodiment of the present invention, the cushioning and energy absorbing mechanism further includes a sleeve member 206 configured to be telescopically moved on the cushioning and energy absorbing mechanism and an elastic member 207 configured to reset the sleeve member 206. The upper end of the clamping component 100 is fixed to the sleeve member 206.

Specifically, one end of the cushioning and energy absorbing mechanism is provided with a sleeve member 206, and the other end of the cushioning and energy absorbing mechanism is fixed with the clamping component 100 at this end, or both ends of the cushioning and energy absorbing mechanism are provided with a sleeve member 206.

Preferably, the cushioning and energy absorbing mechanism according to this embodiment are provided at both ends thereof with a sleeve member 206, and two sleeve members 206 are provided at each end. The elastic member 207 is consisted of two springs, and two opposite sleeve members 206 are mounted on both ends of one spring. Therefore, the clamping component 100 can be laterally extended from the cushioning and energy absorbing mechanism by a certain distance so as to be clamped on the neck and be fixed to the neck by the restoring force of the spring. Such a design has a more compact structure and a good stability of product.

More preferably, the lower end of the clamping component 100 according to this embodiment is further provided with a protective padding 110, which can increase the friction and play a certain protective role.

Figure 7:
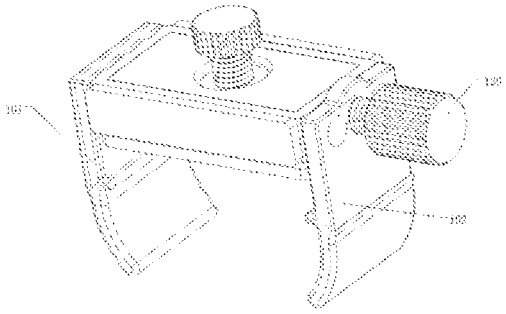
FIG. 7 is a schematic structural view of the broken string energy absorbing device according to a third preferred embodiment of the present invention.

With continued reference to FIG. 7, in a third preferred embodiment of the present invention, the fixing mechanism further includes a fastening bolt 120. The clamping component 100 includes a first clamping component 101 and a second clamping component 102. The first clamping component 101 is fixed at one end of the cushioning and energy absorbing mechanism; and the second clamping component 102 mates with the fastening bolt 120 so as to be mounted at the other end of the cushioning and energy absorbing mechanism. The user can control the clamping and loosening of the clamping component 100 by rotating the fastening bolt 120 to move the second clamping component 102. The degree of the clamping can be freely controlled by the user, and the reliability of the fixing is good.

Figure 8:
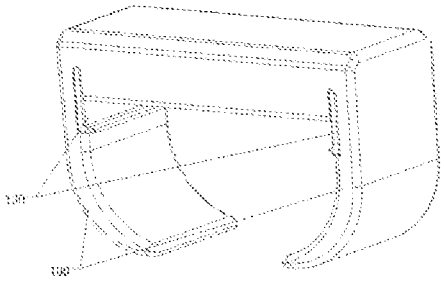
FIG. 8 is a schematic structural view of the broken string energy absorbing device according to a fourth preferred embodiment of the present invention.

With continued reference to FIG. 8, in a fourth preferred embodiment of the present invention, the clamping component 100 and the cushioning and energy absorbing mechanism are integrally made of a silica gel material. The broken string energy absorbing device is further provided with a positioning member 130 that maintains a certain distance between the cushioning and energy absorbing mechanism and the strings. This embodiment adopts an integral molding structure as a whole made of silica gel, and thus has the advantages that the production efficiency is high, and no other adjustment is needed, the operation is simple, and the use is convenient.

Based on the above-mentioned broken string energy absorbing device, the present invention further provides a stringed instrument including a neck. The neck is provided with at least one broken string energy absorbing device as described above. The broken string energy absorbing device is clamped on the neck and is spaced apart from the strings of the stringed instrument by a preset distance. The stringed instrument has a broken string protection function. The stringed instrument according to this embodiment is a guitar. When one broken string energy absorbing device is used, the effect is the best that the broken string energy absorbing device is mounted on the fifth/sixth fret of the neck. When two broken string energy absorbing devices are used simultaneously, the effect is the best that one is mounted on the first/second fret of the neck, and the other is mounted on the sixth/seventh fret of the neck. And after the inventor has repeatedly tested, the protection effect is the best when two broken string energy absorbing devices are used simultaneously.

In summary, the broken string energy absorbing device according to the present invention is firmly fixed on the neck by the fixing mechanism, prevents the sudden smashing of the string when the string is broken by the cushioning mechanism, and absorbs and weakens the energy when the string is broken, which effectively prevents the string from exploding the people when the string is suddenly broken. The cushioning and energy absorbing mechanism is configured to absorb and weaken the energy when the string is broken, which effectively ensures the safety of the user when tuning; and simultaneously, the cushioning and energy absorbing mechanism can make the user no longer have the psychological burden of worrying about whether the string will be broken, so that the user can safely tune the strings, which provides good user experience and is favorable for the user to further learn the instrument.

Simultaneously, the cushioning and energy absorbing mechanism maintains a certain distance from the strings to ensure that the strings can still be driven when the tuning is performed and to determine whether the strings are calibrated or not according to the sound of the strings. The adjusting mechanism can adapt the present invention to different positions on the neck, which increases the adaptability of the present invention and is favorable to increase the humanization of product use.

Moreover, since the cushioning panel 201 can rotate in a plane, the user can adjust the rotation angle thereof, and the cushioning panel 201 can be pressed on a plurality of strings by the adjusting bolt 203, thereby functioning to change or adjust the tone, which enriches the functions of the product, is beneficial to reduce the difficulty of the string fingering method, and further improves the user's entertainment experience.

In addition, the protection effect is the best when two broken string energy absorbing devices are used simultaneously on the guitar, and it is desirable that one is clamped on the first/second fret of the neck and the other is clamped on the sixth/seventh fret. When only one broken string energy absorbing device is used, it is desirable that the broken string energy absorbing device is clamped on the fifth/sixth fret of the neck.

It should be appreciated by those skilled in the art that, equivalent substitutions or changes may be made according to the technical solution of the present invention and the inventive concept thereof, and all such changes or substitutions should fall within the scope of the appended claims of the present invention.

I claim:

1. A broken string energy absorbing device applied to a stringed instrument, the device comprising:

a fixing mechanism; and a cushioning and energy absorbing mechanism, wherein the fixing mechanism is configured to fix the broken string energy absorbing device to a neck of the stringed instrument, and wherein the cushioning and energy absorbing mechanism is disposed on the fixing mechanism and is spaced apart from the strings of the stringed instrument by a preset distance, and is configured to absorb and weaken the energy when a string of the stringed instrument is broken.

2. The broken string energy absorbing device according to claim 1, wherein the fixing mechanism comprises a pair of clamping components for clamping both sides of the neck.

3. The broken string energy absorbing device according to claim 2, wherein the cushioning and energy absorbing mechanism comprises a cushioning panel, and both sides of the cushioning and energy absorbing mechanism and a bottom surface of the cushioning panel are provided with a cushioning layer made of cushioning and energy absorbing material respectively.

4. The broken string energy absorbing device according to claim 3, further comprising an adjusting mechanism configured to adjust the distance between the cushioning and energy absorbing mechanism and the strings.

5. The broken string energy absorbing device according to claim 4, wherein the adjusting mechanism comprises an adjusting bolt;

wherein the cushioning and energy absorbing mechanism is provided at a middle position thereof with a threaded hole that mates with the adjusting bolt; and wherein the cushioning panel is fixed at an end of the adjusting bolt passing through the threaded hole, and rotates in a plane about the end of the adjusting bolt passing through the threaded hole.

6. The broken string energy absorbing device according to claim 2, wherein the clamping component is hinged at a middle position thereof with the cushioning and energy absorbing mechanism, wherein an upper portion of the clamping component is a clamping handle, and wherein a spring is provided between the clamping handle and the cushioning and energy absorbing mechanism for fastening and resetting the clamping component.

7. The broken string energy absorbing device according to claim 2, wherein the cushioning and energy absorbing mechanism further comprises a sleeve member configured to be telescopically moved on the cushioning and energy absorbing mechanism and an elastic member configured to reset the sleeve member; and wherein an upper end of the clamping component is fixed to the sleeve member.

8. The broken string energy absorbing device according to claim 2, wherein the fixing mechanism further comprises a fastening bolt;

wherein the clamping component comprises a first clamping component and a second clamping component;

wherein the first clamping component is fixed at one end of the cushioning and energy absorbing mechanism, and wherein the second clamping component mates with the fastening bolt so as to be mounted at the other end of the cushioning and energy absorbing mechanism.

9. The broken string energy absorbing device according to claim 1, wherein the clamping component and the cushioning and energy absorbing mechanism are integrally made of a silica gel material, and wherein the broken string energy absorbing device is further provided with a positioning member that maintains a certain distance between the cushioning and energy absorbing mechanism and the strings.

10. A stringed instrument comprising a neck, wherein the neck is provided with at least one broken string energy absorbing device according to claim 1, and wherein the broken string energy absorbing device is clamped on the neck and is spaced apart from the strings of the stringed instrument by a preset distance.

* * * * *